US007916106B2

(12) United States Patent
Kim

(10) Patent No.: US 7,916,106 B2
(45) Date of Patent: Mar. 29, 2011

(54) LCD DRIVING DEVICE

(75) Inventor: Woo-Chul Kim, Uijeongbu-si (KR)

(73) Assignee: Samsung Electronics Co., Ltd. (KR)

( * ) Notice: Subject to any disclaimer, the term of this patent is extended or adjusted under 35 U.S.C. 154(b) by 1077 days.

(21) Appl. No.: 11/655,697

(22) Filed: Jan. 19, 2007

(65) Prior Publication Data

US 2007/0241989 A1 Oct. 18, 2007

(30) Foreign Application Priority Data

Apr. 17, 2006 (KR) ..... 10-2006-0034678

(51) Int. Cl.
*G09G 3/36* (2006.01)

(52) U.S. Cl. ..... 345/89

(58) Field of Classification Search ..... 345/88–89, 345/690–693

See application file for complete search history.

(56) References Cited

U.S. PATENT DOCUMENTS

2005/0110750 A1 5/2005 Park
2006/0007091 A1* 1/2006 Yang et al. ..... 345/89

FOREIGN PATENT DOCUMENTS

JP 2001-264818 9/2001
JP 2004-304390 10/2004
JP 2005-157389 6/2005
JP 2005-309326 11/2005
KR 10-2005-0050885 6/2005

OTHER PUBLICATIONS

Patent Abstracts of Japan, Publication No. 2004-304390, Oct. 28, 2004, 2 pp.
Patent Abstracts of Japan, Publication No. 2005-157389, Jun. 16, 2005, 1 p.
Patent Abstracts of Japan, Publication No. 2005-309326, Nov. 4, 2005, 1 p.
Korean Patent Abstracts, Publication No. 1020050050885, Jun. 1, 2005, 1 p.

* cited by examiner

*Primary Examiner* — Alexander Eisen
*Assistant Examiner* — Robin Mishler
(74) *Attorney, Agent, or Firm* — Innovation Counsel LLP

(57) ABSTRACT

In a driving device for an LCD that enables accurate compensation of sub image data, a memory sequentially stores an image data in a frame unit. A memory controller reads out a previous image data corresponding to a previous frame from the memory, stores a present image data corresponding to a present frame in the memory and outputs the previous image data and the present image data. A first converter converts the present image data into a first sub image data and a second sub image data, and a second converter converts the previous image data output into a third sub image data and a fourth sub image data. A first compensator compensates the first sub image data using the third sub image data, and a second compensator compensates the second sub image data using the fourth sub image data.

10 Claims, 8 Drawing Sheets

LCD DRIVING DEVICE

RELATED APPLICATIONS

This application claims priority of Korean Patent Application No. 2006-34678, filed Apr. 17, 2006, the entire contents of which are incorporated herein by reference.

BACKGROUND

The present invention relates to an LCD having a driving device capable of compensating image data so as to improve the quality of the image produced by the LCD.

Compared to cathode ray tube (CRT) displays, liquid crystal displays (LCDs) are typically thinner but have a relatively narrower viewing angle. In an effort to improve the narrow viewing angle of LCDs, various types of liquid crystal alignment techniques have recently been developed, such as patterned vertical alignment (PVA), multi-domain vertical alignment (MVA), super-patterned vertical alignment (S-PVA), and the like.

In the S-PVA type of LCD, each of the pixels includes two subpixels, and the two subpixels include main and sub pixel electrodes, respectively. In order to form domains having a different gray value within one pixel, two different sub-voltages are applied to the main and sub pixel electrodes, respectively. Since the eyes of a viewer of the display perceive an intermediate value between those generated by the two different sub-voltages, the gamma curve of the display is modified to an intermediate gray, thereby preventing a degradation of the side viewing angle of the display.

Recently, S-PVA types of LCDs have begun to employ a method of dynamic capacitance compensation (DCC) in order to enhance the response speed of the liquid crystal molecules thereof. The DCC method applies a compensated gray scale value to a present frame that is a function of a target gray scale value of the present frame and the gray scale value of a previous frame. The display compensates the input gray scale value to generate a compensated gray scale value before dividing it into the two sub-gray scale values, and then generates the two sub-gray scale values based on the compensated gray scale value. However, when the two sub-gray scale values are generated on the basis of the compensated gray scale value, the S-PVA type liquid crystal display cannot then apply an optimized compensated gray scale value to the two subpixels, thereby resulting in a deterioration of the response speed and image quality of the display.

BRIEF SUMMARY

In accordance with the exemplary embodiments thereof described herein, the present invention provides a driving device capable of independently compensating sub image data for subpixels, as well as an LCD incorporating the novel driving device.

In one exemplary embodiment, an LCD driving device includes a memory, a memory controller, a first converter, a second converter, a first compensator, a second compensator and an output part.

The memory sequentially stores an image data in a frame unit. The memory controller reads out a previous image data corresponding to a previous frame previously stored in the memory, stores a present image data corresponding to a present frame from an external source in the memory, and outputs the previous image data and the present image data.

The first converter converts the present image data output from the memory controller into a first sub image data and a second sub image data having a different gray scale value from the first sub image data. The second converter converts the previous image data output from the memory controller into a third sub image data and a fourth sub image data having a different gray scale value from the third sub image data.

The first compensator compensates the first sub image data using the third sub image data and outputs a first compensated image data, and the second compensator compensates the second sub image data using the fourth sub image data and outputs a second compensated image data. The output part controls an output time of the first and second compensated image data.

In another exemplary embodiment, an LCD includes a memory, a timing controller, a gamma reference voltage generator, a data driver, a gate driver and a display panel.

The memory sequentially stores an image data in a frame unit, and the timing controller receives image data corresponding to two successive frames and sequentially outputs a first compensated image data and a second compensated image data. The gamma reference voltage generator outputs a gamma reference voltage in response to a power voltage from an external source. Based on the gamma reference voltage, the data driver converts the first compensated image data into a first data voltage during a first period and the second compensated image data into a second data voltage during a second period. The gate driver outputs a first gate signal and a second gate signal during the first and second periods, respectively.

The display panel includes a plurality of pixels arranged to display an image. Each of the pixels includes a first subpixel to which the first gate signal and the first data voltage are applied, and a second subpixel to which the second gate signal and the second voltage are applied.

The timing controller includes a memory, a memory controller, a first converter, a second converter, a first compensator, a second compensator and an output part.

The memory sequentially stores an image data in a frame unit. The memory controller reads out a previous image data corresponding to a previous frame previously stored in the memory, stores a present image data corresponding to a present frame from an external source in the memory, and outputs the previous image data and the present image data.

The first converter converts the present image data output from the memory controller into a first sub image data and a second sub image data having a different gray scale value from the first sub image data. The second converter converts the previous image data output from the memory controller into a third sub image data and a fourth sub image data having a different gray scale value from the third sub image data.

The first compensator compensates the first sub image data using the third sub image data and outputs a first compensated image data, and the second compensator compensates the second sub image data using the fourth sub image data and outputs a second compensated image data. The output part controls an output time of the first and second compensated image data.

In accordance with the above exemplary embodiments, the image data from an external source, such as a graphics controller, is converted into the first and second sub image data, and the first and second sub data are independently compensated to generate the first and second compensated image data, thereby providing an optimized compensated image data to the first and second sub pixels.

A better understanding of the above and many other features and advantages of the driving devices of the invention and the LCDs incorporating them may be obtained from a consideration of the detailed description of some exemplary embodiments thereof below, particularly if such consideration is made in conjunction with the appended drawings, wherein like reference numerals are used to identify like elements illustrated in one or more of the figures thereof.

DETAILED DESCRIPTION

Figure 1:
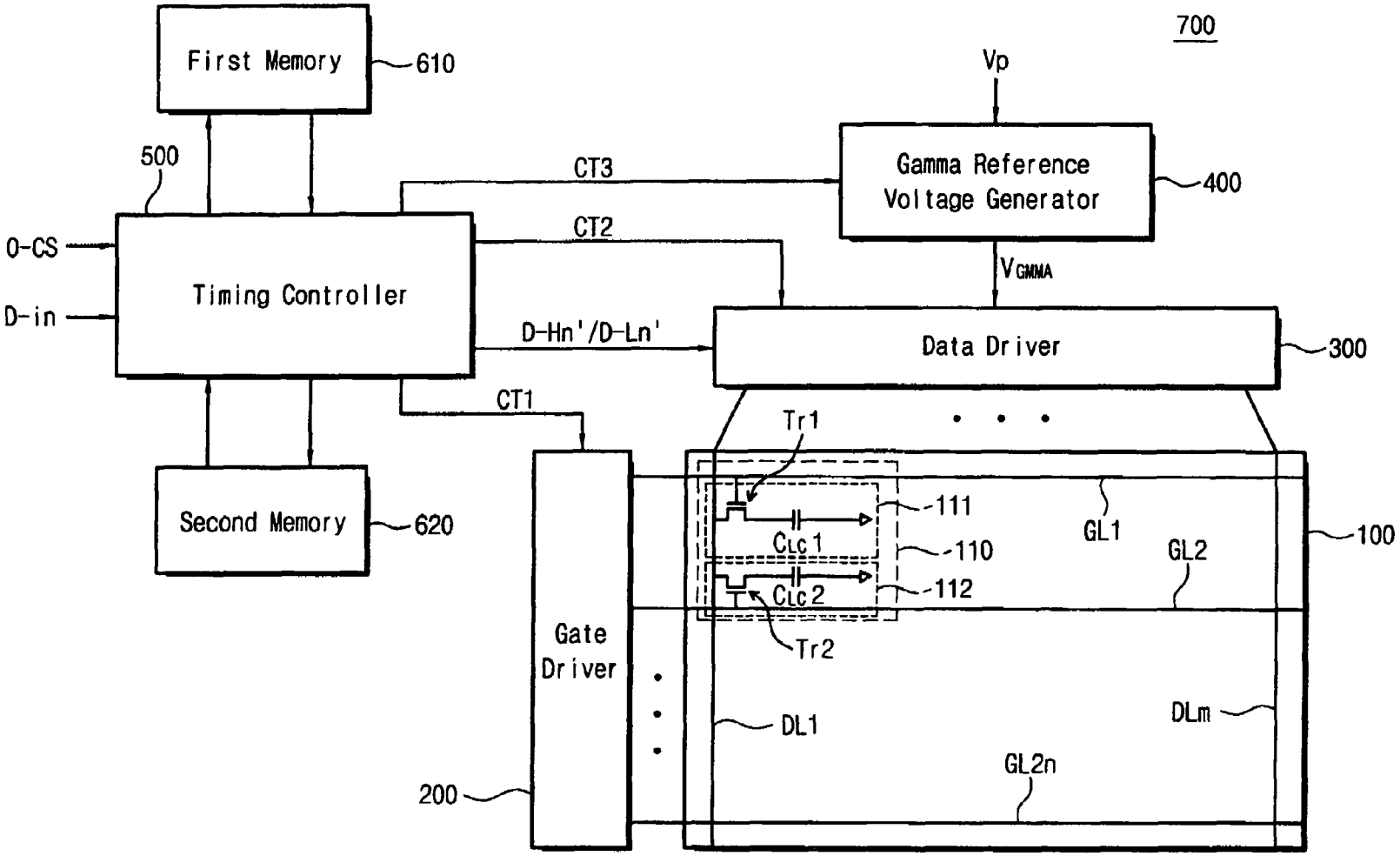
FIG. 1 is a functional block diagram of an LCD incorporating an exemplary embodiment of a driving device in accordance with the present invention.
Figure 2:
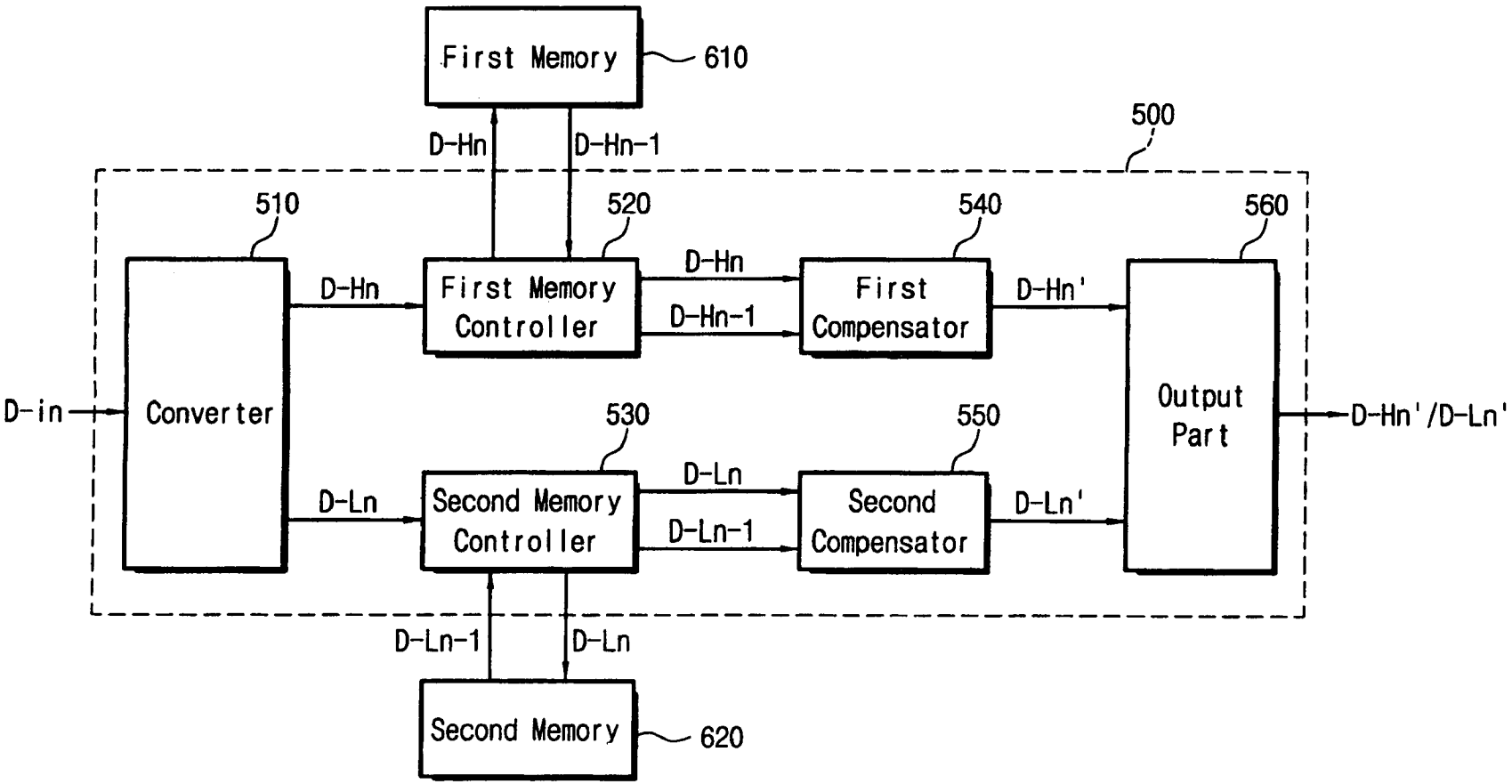
FIG. 2 is a functional block diagram of a timing controller of the LCD driving device of FIG. 1.

FIG. 1 is a functional block diagram of an LCD 700 incorporating an exemplary embodiment of a driving device in accordance with the present invention, and FIG. 2 is a functional block diagram of a timing controller 500 of the driving device of FIG. 1. Referring to FIG. 1, the LCD 700 includes a display panel 100, a gate driver 200, a data driver 300, a gamma reference voltage generator 400, a timing controller 500, a first memory 610 and a second memory 620.

The display panel 100 includes a plurality of gate lines GL1-GL2*n* to which gate voltages are respectively applied and a plurality of data lines DL1-DLm to which data voltages are respectively applied. The gate lines GL1-GL2*n* and the data lines DL1-DLm define a plurality of pixels disposed in a matrix configuration on the display panel 100. Each of the pixels 110 includes respective first and second subpixels 111 and 112 therein. The first subpixel 111 includes a first thin film transistor Tr1 and a first liquid crystal capacitor CLC1, and the second subpixel 112 includes a second thin film transistor Tr2 and a second liquid crystal capacitor CLC2.

The gate driver 200 is electrically connected to the gate lines GL1-GL2*n* on the display panel 100 to apply gate signals to respective ones of the gate lines GL1-GL2*n*. The data driver 300 is electrically connected to the data lines DL1-DLm on the display panel 100 to apply a first data voltage or a second data voltage to respective ones of the data lines DL1-DLm.

The timing controller 500 receives image data D-in and various control signal O-CS from an external graphics controller (not illustrated). The timing controller 500 compensates the image data D-in and outputs first compensated image data D-Hn' or second compensated image data D-Ln'. The timing controller 500 receives the various control signals O-CS, such as a vertical synchronous signal, a horizontal synchronous signal, a main clock, a data enable signal, and outputs first, second and third control signals CT1, CT2 and CT3.

The first control signal CT1 is applied to the gate driver 200 to control the operation of the gate driver 200. The first control signal CT1 includes a vertical start signal that starts operation of the gate driver 200, a gate clock signal that determines the output timing of the gate voltages, and an output enable signal that determines the pulse-width of the gate voltages. The gate driver 200 sequentially outputs the gate signals to the gate lines GL1-GL2*n* in response to the first control signal CT1 from the timing controller 500.

The second control signal CT2 is applied to the data lines DL1-DLm to control the operation of the data driver 300. The second control signal CT2 includes a horizontal start signal that starts the operation of the data driver 300, an inversion signal that inverts the polarity of the data voltages, and an output indicating signal that determines the output timing of the first data voltages or the second data voltages. The data driver 300 receives the first compensated image data D-Hn' or the second compensated image data D-Ln' corresponding to the pixels of one row of the display panel 100 in response to the second control signal CT2 from the timing controller 500.

The gamma reference voltage generator 400 receives a power source voltage from an external source (not illustrated) and generates a gamma reference voltage VGMMA in response to the third control signal CT3 from the timing controller 500. On the basis of the gamma reference voltage VGMMA from the gamma reference voltage generator 400, the data driver 300 converts the first compensated image data D-Hn' into the first data voltage during a first period in which the first subpixel 111 is driven to output the converted first data voltage, and the data driver 300 converts the second compensated image data D-Ln' into the second data voltage during a second period in which the second subpixel 112 is driven. In the exemplary embodiment of FIGS. 1 and 2, the first data voltage has a higher voltage level than the second data voltage.

As illustrated in more detail in FIG. 2, the timing controller 500 includes a converter 510, a first memory controller 520, a second memory controller 530, a first compensator 540, a second compensator 550 and an output part 540.

The converter 510 receives the image data D-in of one frame and converts it into a first sub image data D-Hn and a second sub image data D-Ln having a different value from the first sub image data D-Hn. More specifically, the first sub image data D-Hn has a higher gray scale value than that of the second sub image data D-Ln.

The first memory controller 520 reads out a first sub image data D-Hn-1 (referred to herein as a first previous sub image data) of a previous frame that was previously stored in the first memory 610, and stores the first sub image data D-Hn (referred to herein as a first present sub image data) of a present frame from the converter 510 in the first memory 610.

The second memory controller 530 reads out a second sub image data D-Ln-1 (referred to herein as a second previous sub image data) of the previous frame that was previously stored in the second memory 620, and stores the second sub image data D-Ln (referred to herein as a second present sub image data) of the present frame from the converter 510 in the second memory 610.

In the particular exemplary embodiment of FIGS. 1 and 2, the first and second memories 610 and 620 are frame memories that store the image data in frame units.

The first compensator 540 compensates the first previous sub image data D-Hn based on the first previous sub image data D-Hn-1 and outputs the first compensated image data D-Hn'. When the value of the difference between the first previous sub image data D-Hn-1 and the first present sub image data D-Hn is greater than a selected first reference value, the first compensator 540 adds a selected first compensated value al to the first present sub image data D-Hn to generate the first compensated image data D-Hn'. When the value of the difference between the first previous sub image data D-Hn-1 and the first present sub image data D-Hn is less than the first reference value, the first compensator 540 outputs the first present sub image data D-Hn as the first compensated image data D-Hn'.

The second compensator 550 compensates the second previous sub image data D-Ln based on the second previous sub image data D-Ln-1 and outputs the second compensated image data D-Ln'. When the value of the difference between the second previous sub image data D-Ln-1 and the second present sub image data D-Ln is greater than a selected second reference value, the second compensator 550 adds a selected second compensated value $\alpha$2 to the second present sub image data D-Ln to generate the second compensated image data D-Ln', and when value of the difference is less than the second reference value, outputs the second present sub image data D-Ln as the second compensated image data D-Ln'.

The output part 560 receives the first compensated image data D-Hn' from the first compensator 540 and the second compensated image data D-Ln' from the second compensator 550. The output part 560 outputs the first compensated image data D-Hn' while the first subpixel 111 is being driven and outputs the second compensated image data D-Ln' while the second subpixel 112 is being driven.

After the image data D-in is converted into the first sub image data D-Hn and the second sub image data D-Ln, the first and second sub image data D-Hn and D-Ln are compensated to the first and second compensated image data D-Hn' and D-Ln', respectively. Thus, the first and second compensated image data D-Hn' and D-Ln' may be optimized and applied to the first and second subpixels 111 and 112, respectively.

Figure 3:
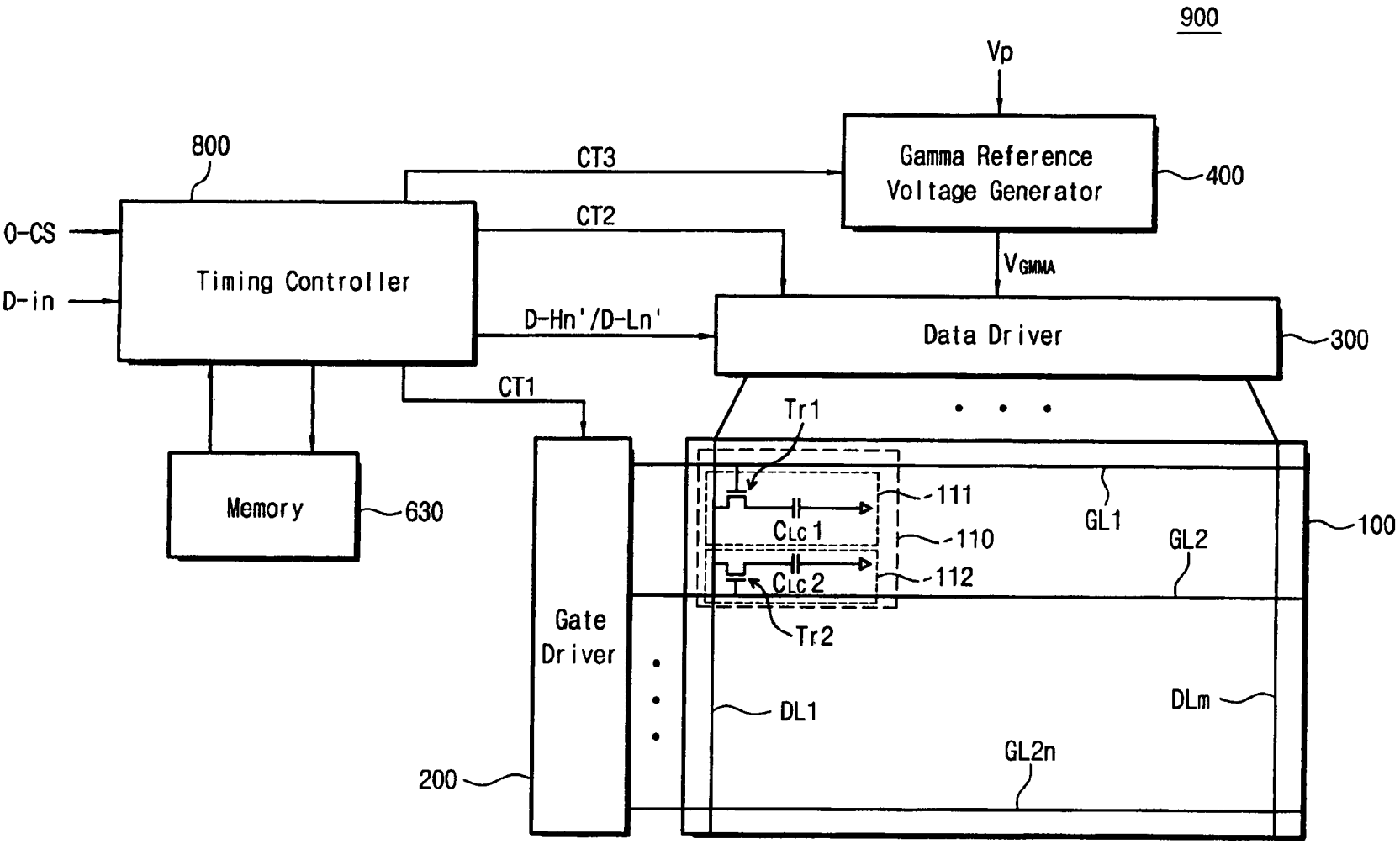
FIG. 3 is a functional block diagram of an LCD incorporating another exemplary embodiment of a driving device in accordance with the present invention.
Figure 4:
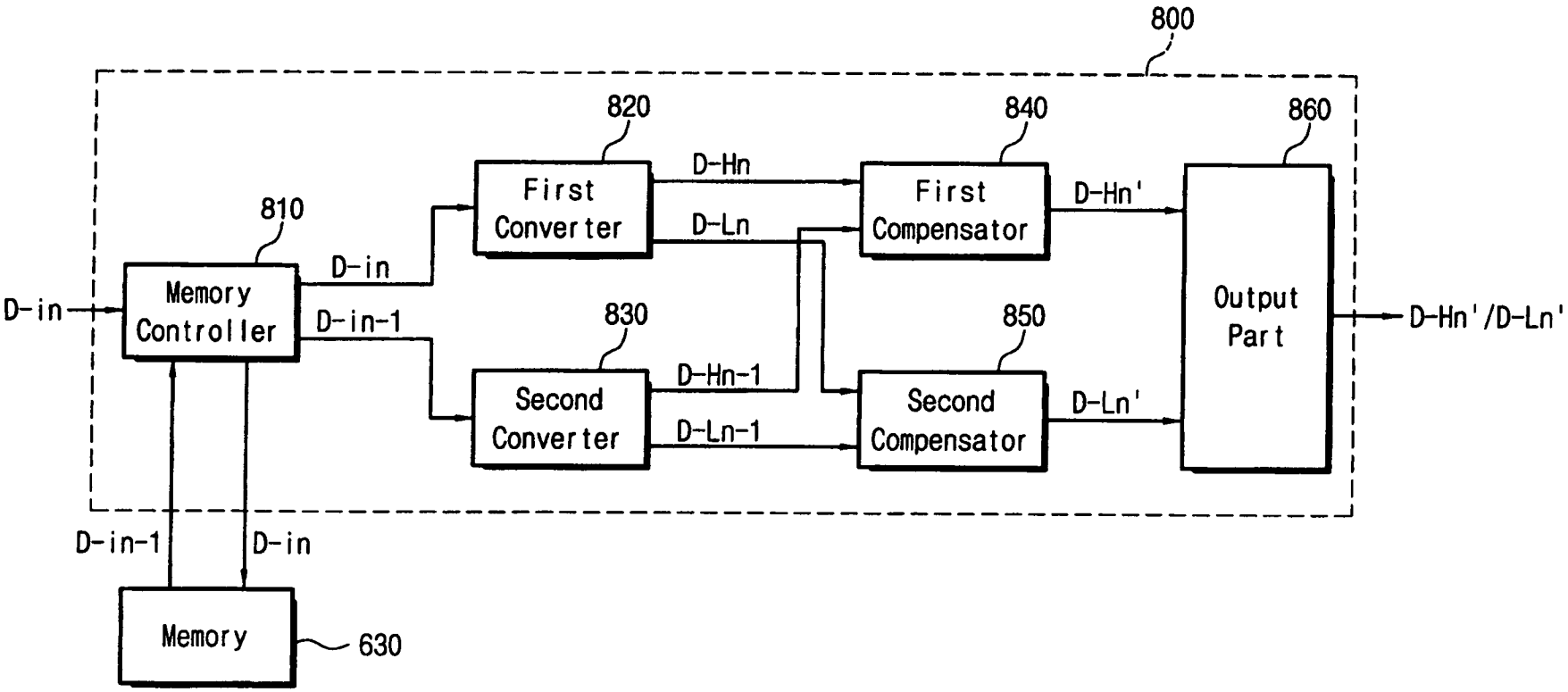
FIG. 4 is a block diagram of a timing controller of the LCD driving device of FIG. 3.

FIG. 3 is a functional block diagram of an LCD 900 incorporating another exemplary embodiment of a driver device in accordance with the present invention, and FIG. 4 is a block diagram of a timing controller of the LCD driving device of FIG. 3. In the LCD 900 of FIG. 3, the same reference numerals denote the same elements as those of the LCD 700 of FIG. 1, and accordingly, further description of these elements is omitted for brevity.

Referring to FIG. 3, the second exemplary embodiment of the LCD 900 includes a display panel 100, a gate driver 200, a data driver 300, a gamma reference voltage generator 400, a timing controller 800 and a single memory 630. As illustrated in FIG. 4, the timing controller 800 of the LCD 900 includes a memory controller 810, a first converter 820, a second converter 830, a first compensator 840, a second compensator 850 and an output part 860.

The memory controller 810 receives a present image data D-in corresponding to a present frame from an external source (not illustrated). The memory controller 810 reads out a previous image data D-in-1 corresponding to a previous frame and previously stored in the memory 630, and the memory controller 810 stores the present image data D-in in the memory 630. The memory controller 810 outputs the present image data D-in and the previous image data D-in-1.

The first converter 820 receives the present image data D-in and converts it into a first sub image data D-Hn and a second sub image data D-Ln having a different gray scale value from that of the first sub image data D-Hn. More particularly, the first sub image data D-Hn has a higher gray scale value than that of the second sub image data D-Ln.

The second converter 830 receives the previous image data D-in-1 and converts it into a third sub image data D-Hn-1 and a fourth sub image data D-Ln-1 having a different gray scale value from that of the third sub image data D-Hn-1. More particularly, the third sub image data D-Hn-1 has a higher gray scale value than that of the fourth sub image data D-Ln-1.

The first compensator 840 compensates the first sub image data D-Hn from the first converter 820, based on the third sub image data D-Hn-1 from the second converter 830, and outputs a first compensated image data D-Hn'. When the value of the difference between the third sub image data D-Hn-1 and the first sub image data D-Hn is greater than a selected first reference value, the first compensator 840 adds a selected first compensated value al to the first sub image data D-Hn to generate the first compensated image data D-Hn'. When the value of the difference between the third sub image data D-Hn-1 and the first sub image data D-Hn is less than the first reference value, the first compensator 840 generates the first sub image data D-Hn as the first compensated image data D-Hn'.

The second compensator 850 compensates the second sub image data D-Ln from the first converter 820, based on the fourth sub image data D-Ln-1 from the second converter 830, to output a second compensated image data D-Ln'. When the value of the difference between the fourth sub image data D-Ln-1 and the second sub image data D-Ln is greater than a selected second reference value, the second compensator 850 adds a selected second compensated value $\alpha$2 to the second sub image data D-Ln to generate the second compensated image data D-Ln', and when the value of the difference is less than the second reference value, generates the second sub image data D-Ln as the second compensated image data D-Ln'.

The output part 860 receives the first compensated image data D-Hn' from the first compensator 840 and the second compensated image data D-Ln' from the second compensator 850. The output part 860 then outputs the first compensated image data D-Hn' during a first period in which the first subpixel 111 is being driven and outputs the second compensated image data D-Ln' during a second period in which the second subpixel 112 is being driven.

After the image data D-in is converted into the first and second sub image data D-Hn and D-Ln, the first and second sub image data D-Hn and D-Ln are compensated to the first and second compensated image data D-Hn' and D-Ln', respectively. Thus, the first and second compensated image data D-Hn' and D-Ln' may then be optimized and applied to the first and second subpixels 111 and 112, respectively.

Additionally, the timing controller 800 stores the image data D-in in the memory 630 before the image data D-in is converted into the first and second sub image data D-Hn and D-Ln. Thus, the LCD 900 needs only one memory sequentially storing the image data D-in in a frame unit, thereby reducing the number of the memories used in the LCD 900.

Figure 5:
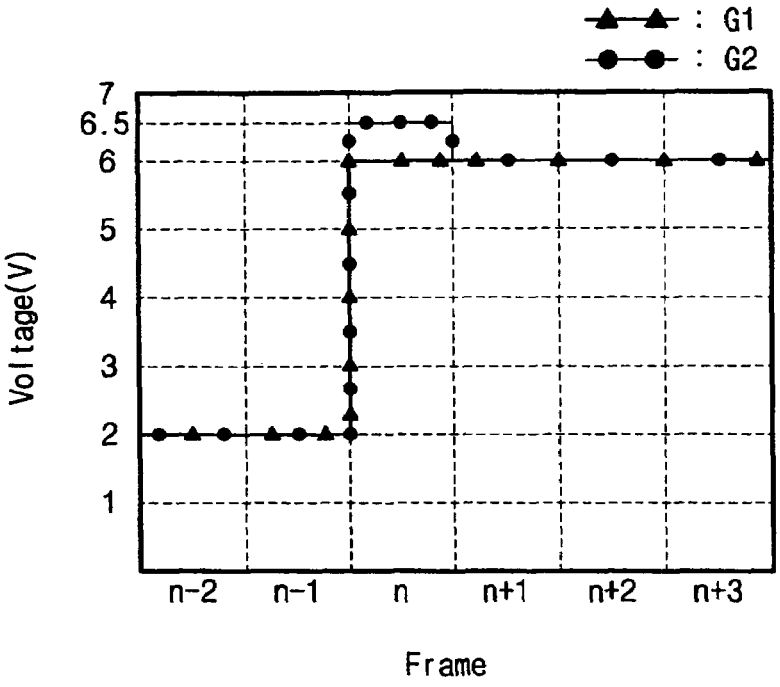
FIG. 5 is a graph of input and output signals of a first compensator of the timing controllers of FIGS. 2 and 4.
Figure 6:
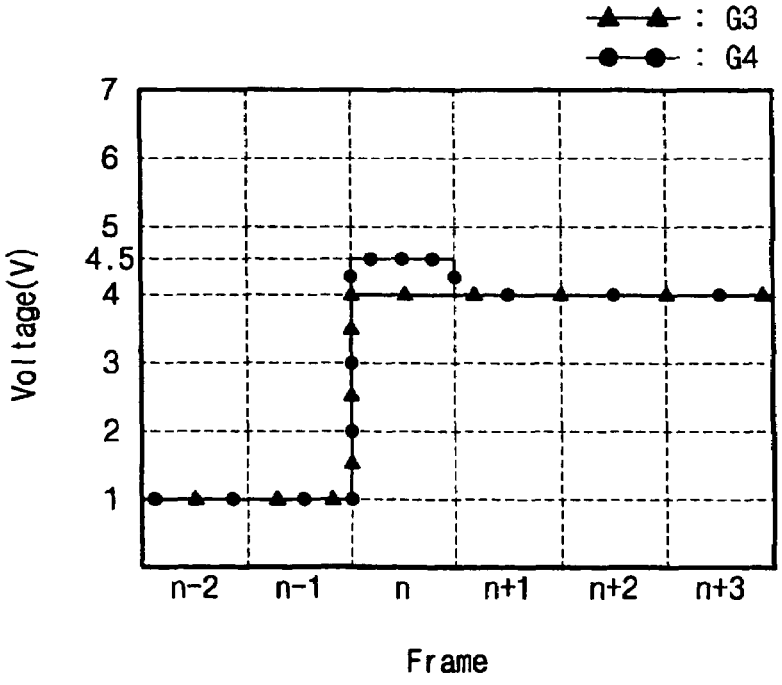
FIG. 6 is a graph of input and output signals of a second compensator of the timing controllers of FIGS. 2 and 4.

FIG. 5 is a graph of the input and output signals of the first compensators 540 and 840 of the timing controllers 500 and 800 of FIGS. 2 and 4, and FIG. 6 is a graph of the input and output signals of the second compensators 550 and 850 thereof. In FIGS. 5 and 6, the y-axes respectively represent voltage levels and the x-axes respectively represent frame numbers.

In the graph of FIG. 5, the first plot G1 shows the input signal inputted into the first compensators 540 and 840 of FIGS. 2 and 4, respectively, and the second plot G2 shows the output signal outputted from the first compensators 540 and 840, respectively, as a function of the frame number. In the graph of FIG. 6, the third plot G3 shows the input signal inputted into the second compensators 550 and 850 of FIGS. 2 and 4, respectively, and the fourth graph G4 shows the output signal outputted from the second compensator 550 and 850, as a function of frame number.

As shown by the first plot G1 of FIG. 5, the input signal is maintained at about 2 volts in the (n−2)th and (n−1)th frames, and at about 6 volts in the n-th and (n+3)th frames. (In the particular embodiments described, the voltages are represented as absolute values.)

As shown by the second plot G2 of FIG. 5, since the value of the difference (viz., about 4 volts) between the first sub image data D-Hn in the n-th frame and the third sub image data D-Hn-1 in the (n−1)th frame is greater than a selected first reference value (viz., about 3 volts), the first compensator 840 outputs the first compensated image data D-Hn' at the n-th frame, which has a voltage level greater than the first sub image data D-Hn by the first compensated value (viz., about 0.5 volts).

As shown by the third plot G3 of FIG. 6, the input signal is maintained at about 1 volt in the (n−2)th and (n−1)th frames, and at about 4 volts in the n-th and (n+3)th frames. (Again, the voltages represented are absolute values).

As indicated by the fourth plot G4 of FIG. 6, since the value of the difference (viz., about 3 volts) between the second sub image data D-Ln in the n-th frame and the fourth sub image data D-Ln-1 in the (n−1)th frame is greater than a selected second reference value (viz., about 2 volts), the second compensator 850 outputs the second compensated image data D-Ln' at the n-th frame, which has a voltage level greater than the second sub image data D-Ln by the second compensated value (viz., about 0.5 volts).

Figure 7:
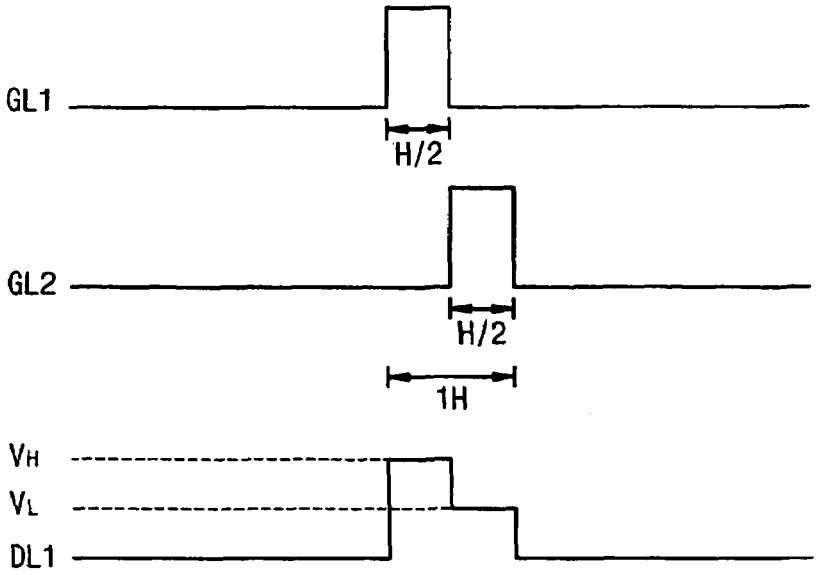
FIG. 7 is a waveform diagram of signals applied to a first data line, a first gate line and a second gate line of the LCDs of FIGS. 1 and 3.

FIG. 7 is a waveform diagram of signals respectively applied to the first data line DL1, the first gate line GL1 and the second gate line GL2 of the respective LCD panels 100 of FIGS. 1 and 3. As illustrated in FIG. 7, a first gate signal at a high state is applied to the first gate line GL1 at an earlier, first H/2 time period of a 1H time period during which only the first subpixel 111 is driven, and a second gate signal at a high state is applied to the second gate line GL1 at a later, second H/2 time period during which only the second subpixel 112 is driven. Thus, the pixel is driven during the entire 1H time period, but with the first and second subpixels being driven only during first and second H/2 periods thereof, respectively.

The first thin film transistor Tr1 of the first subpixel outputs a first data voltage VH applied to the first data line DL1 in response to the first gate signal. The second thin film transistor Tr2 of the second subpixel outputs a second data voltage VL applied to the first data line DL1 in response to the second gate signal. The second data voltage VL has a lower voltage level than that of the first data voltage VH. Thus, the first liquid crystal capacitor CLC1 of the first pixel is charged to the first data voltage VH, and the second liquid crystal capacitor CLC2 of the second pixel is charged to the second data voltage VL.

Figure 8:
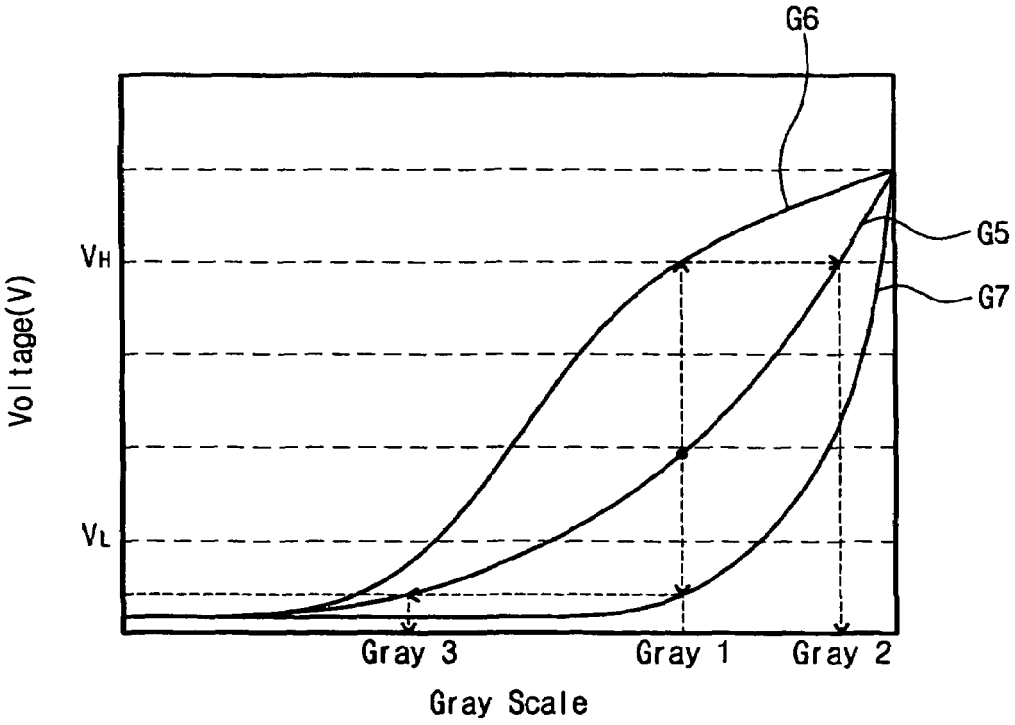
FIG. 8 is a graph of voltages of first and second subpixels of the LCDs of FIGS. 1 and 3 as a function of a gray scale.

FIG. 8 is a graph of the respective voltages VH and VL of the first and second subpixels 111 and 112 as a function of gray scale values. In FIG. 8, the y-axis represents voltages and the x-axis represents corresponding gray scale values, respectively. Also shown in FIG. 8 are a fifth plot G5 illustrating a first gamma curve of the present image data D-in (see FIGS. 2 and 4), a sixth graph G6 illustrating a second gamma curve of the first sub image data D-Hn, and a seventh graph G7 illustrating a third gamma curve of the second sub image data D-Ln. As illustrated in FIG. 8, the second gamma curve G6 has a higher voltage level than the first gamma curve G5, and the first gamma curve G5 has a higher voltage level than the third gamma curve G7, at every common gray scale value of the three gamma curves, e.g., at Gray 1, Gray 2 and Gray 3.

In the particular exemplary embodiment illustrated in FIG. 8, the first sub image data D-Hn is converted into a second gray scale value (Gray 2) of the first gamma curve corresponding to the first data voltage VH of the second gamma curve represented at the first gray scale value (Gray 1) of the present image data D-in. Also, the second sub image data D-Ln is converted into a third gray scale value (Gray 3) of the first gamma curve corresponding to the second data voltage VL of the third gamma curve represented at the first gray scale value (Gray 1) of the present image data D-in.

Thus, when the first and second data voltages VH and VL are applied to the first and second subpixels 111 and 112, respectively, the respective brightness of the pixels is different at every gray scale value. That is, the first subpixel 111 has higher brightness than that of the second sub subpixel 112 with respect to any gray scale value. As a result, a viewer of the S-PVA type LCDs 700 and 900 will perceive an intermediate value of brightness that is disposed between that produced by the first and second data voltages VH and VL, respectively. Thus, the S-PVA type LCDs 700 and 900 thereby prevent degradation of the side viewing angle of the displays as a result of distortion of the gamma curve in an intermediate gray.

Figure 9:
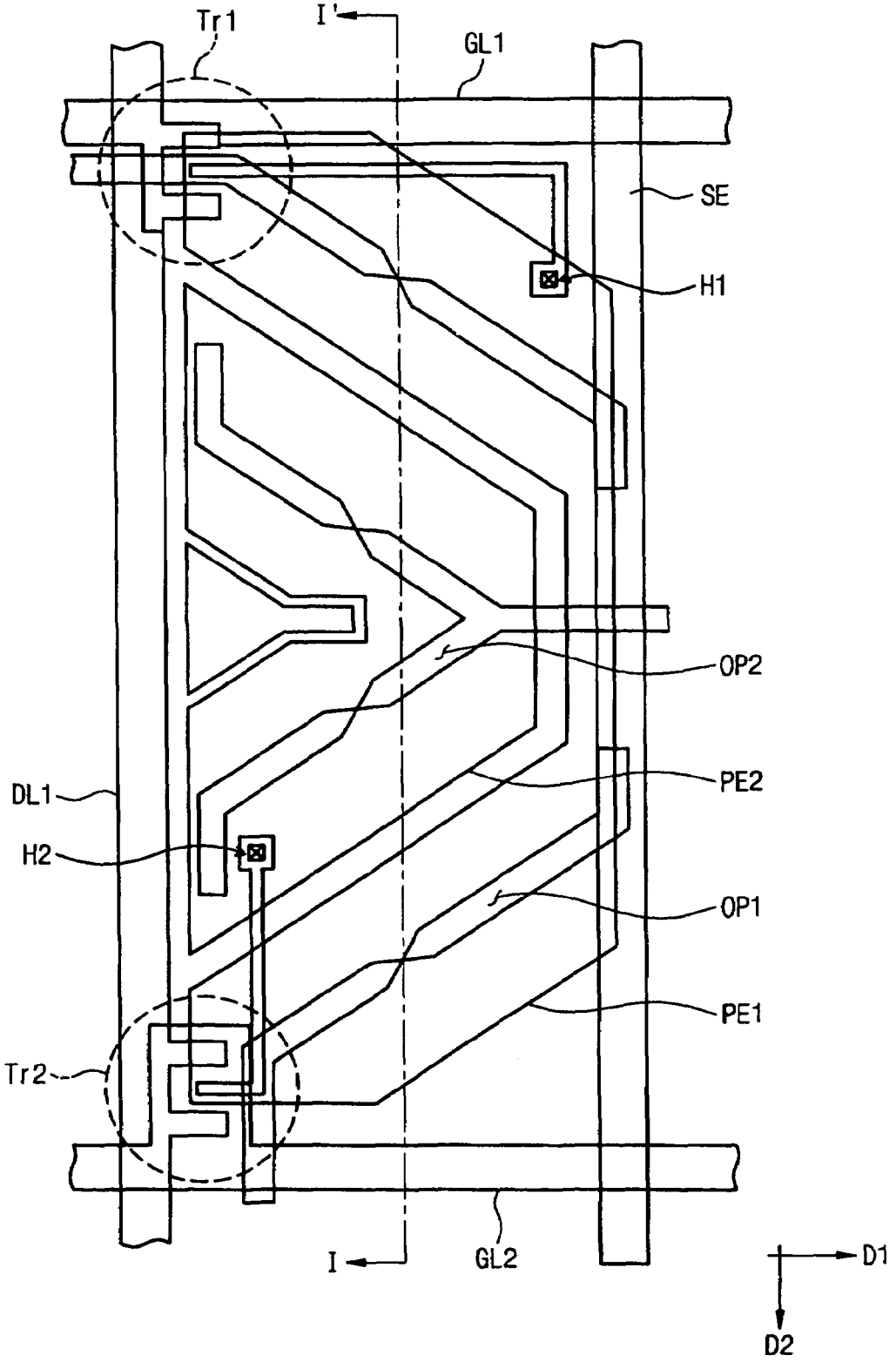
FIG. 9 is a partial plan view of a single pixel of a display panel of the LCDs of FIGS. 1 and 3; and, FIG. 10 is a partial cross-sectional view of the display panel of FIG. 9, as seen along the section lines I-I' taken therein.
Figure 10:
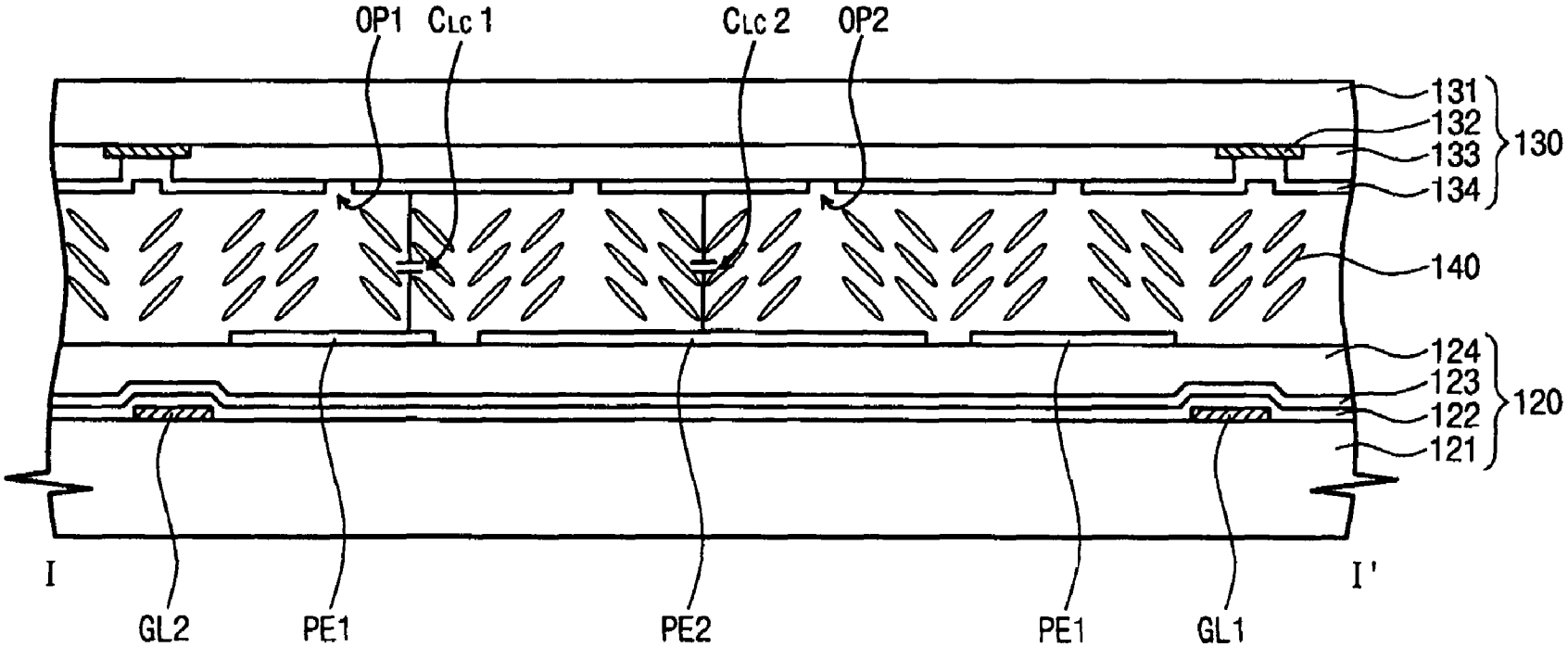

FIG. 9 is a partial plan view of a single pixel region of the display panels 100 of the LCDs 700 and 800 of FIGS. 1 and 3, and FIG. 10 is a partial cross-sectional view of the panel of FIG. 9, as seen along the section lines I-I' taken therein. As illustrated in FIGS. 9 and 10, the display panel 100 includes an array substrate 120, a color filter substrate 130 facing the array substrate 120 in spaced opposition and a liquid crystal layer 140 interposed between the array substrate 120 and the color filter substrate 130 to display an image.

The array substrate 120 includes a first base substrate 121 on which a pixel region is defined by first and second gate lines GL1 and GL2 that extend in a first direction D1 and a first data line DL1 that extends in a second direction D2 substantially perpendicular to the first direction D1. The pixel, which includes the first and second subpixels, is formed in the pixel region. The first sub pixel includes a first thin film transistor Tr1 and a first pixel electrode PE1 used as a first electrode of a first liquid crystal capacitor CLC1, and the second sub pixel includes a second thin film transistor Tr2 and a second pixel electrode PE2 used as a first electrode of a second liquid crystal capacitor CLC2.

The first thin film transistor Tr1 has a gate electrode that branches out from the first gate line GL1, a source electrode that branches out from the first data line DL1, and a drain electrode electrically connected to the first pixel electrode PE1. The second thin film transistor Tr2 has a gate electrode that branches from the second gate line GL2, a source electrode that branches out from the first data line DL1, and a drain electrode electrically connected to the second pixel electrode PE2.

As illustrated in FIG. 10, the array substrate 120 further includes a gate insulating layer 121, a passivation layer 122 and an organic insulating layer 123. The gate insulating layer 121, the passivation layer 122 and the organic insulating layer 123 are formed below the first and second pixel electrodes PE1 and PE2 to cover the first and second gate lines GL1 and GL2.

The color filter substrate 130 includes a second base substrate 132 on which a black matrix 132, a color filter layer 133 and a common electrode 134 are formed. The black matrix 132 is formed in the regions in which the first and second gate lines GL1 and GL2 are disposed, and in which no image is produced, to prevent light leakage. The color filter layer 133 includes red, green and blue color pixels to display colors corresponding to the light passing through the liquid crystal layer 140.

The common electrode 134 is used as the second electrode of the first and second liquid crystal capacitors CLC1 and CLC2 and formed on the color filter layer 133. The common electrode 134 is partially removed from the color filter substrate 130 in areas corresponding to the center portions of the first and second pixel electrodes PE1 and PE2. Thus, as illustrated in FIG. 10, a first opening OP1 corresponding to the center portion of the first pixel electrode PE1 is formed through the common electrode 134, and a second opening OP2 corresponding to the center portion of the second pixel electrode PE2 is formed through the common electrode 134. Accordingly, eight domains, each of which has liquid crystal molecules respectively arranged in different directions, are formed in the pixel region.

According to the exemplary embodiments of the LCD driving devices and the LCDs incorporating them described above, externally supplied image data is converted into first and second sub image data, and the first and second sub image data are then compensated to first and second compensated image data by the first and second compensators.

Thus, the first and second sub image data is independently compensated, thereby providing optimized compensated image data to the first and second subpixels. Further, the image data can be sequentially stored in the memory in the frame unit before converting the image data into the first and second sub image data. The display apparatus therefore requires only one memory, thereby reducing the number of the memories required.

By now, those of skill in this art will appreciate that many modifications, substitutions and variations can be made in and to the LCD driver devices and the LCDs incorporating them of the present invention without departing from its spirit and scope. In light of this, the scope of the present invention should not be limited to that of the particular embodiments illustrated and described herein, as they are only exemplary in nature, but instead, should be fully commensurate with that of the claims appended hereafter and their functional equivalents.

What is claimed is:

1. An LCD driving device, comprising:

a memory operable to sequentially store an image data in a frame unit;

a memory controller operable to read out a previous image data corresponding to a previous frame previously stored in the memory, store a present image data corresponding to a present frame from an external source in the memory and output the previous image data and the present image data;

a first converter operable to convert the present image data output from the memory controller into a first sub image data and a second sub image data having a gray scale value less than a gray scale of the first sub image data;

a second converter operable to convert the previous image data output from the memory controller into a third sub image data and a fourth sub image data having a gray scale value less than a gray scale of the third sub image data;

a first compensator operable to compensate the first sub image data based on a difference value between the first sub image data and the third sub image data and output a first compensated image data;

a second compensator adapted to compensate the second sub image data based on a difference value between the second sub image data and the fourth sub image data and output a second compensated image data; and, an output part to control an output time of the first and second compensated image data.

2. The driving device of claim 1, wherein:

each of first, second and third gamma curves defines a respective functional relationship between a gray scale value and a corresponding voltage, the second gamma curve has a higher voltage level than the first gamma curve, and the first gamma curve has a higher voltage level than the third gamma curve, at every common gray scale value of the gamma curves, the image data corresponds to a point on the first gamma curve, the first sub image data corresponds to a point on the second gamma curve, and the second sub image data corresponds to a point on the third gamma curve.

3. The driving device of claim 1, wherein:

the first sub image data is converted into a second gray scale value of the first gamma curve corresponding to a voltage of the second gamma curve at a first gray scale level of the image data, and the second sub image data is converted into a third gray scale value of the first gamma curve corresponding to a voltage of the third gamma curve at the first gray scale value of the image data.

4. The driving device of claim 1, wherein:

the first compensator generates the first compensated image data having a same value as that of the third sub image data when the value of the difference between the first sub image data and the third sub image data is less than a first reference value, and the first compensator generates the first compensated image data having a larger value than the third sub image data by a first compensated value when the value of the difference is greater than the first predetermined reference value.

5. The driving device of claim 1, wherein:

the second compensator generates the second compensated image data having a same value as that of the fourth sub image data when the value of the difference between the second sub image data and the fourth sub image data is less than a second reference value, and the second compensator generates the second compensated image data having a larger value than the fourth sub image data by a second compensated value when the value of the difference is greater than the second reference value.

6. The driving device of claim 1, wherein the output part outputs the first and second compensated image data sequentially.

7. An LCD, comprising:

a memory to sequentially store an image data in a frame unit;

a timing controller to receive image data corresponding to two successive frames and sequentially output a first compensated image data and a second compensated image data;

a gamma reference voltage generator to output a gamma reference voltage in response to a power voltage from an external source;

a data driver to convert the first compensated image data into a first data voltage based on the gamma reference voltage during a first period and to convert the second compensated image data into a second data voltage based on the gamma reference voltage during a second period;

a gate driver to output a first gate signal and a second gate signal during the first and second periods, respectively; and, a display panel having a plurality of pixels to display an image, each of the pixels having a first subpixel to which the first gate signal and the first data voltage are applied and a second subpixel to which the second gate signal and the second voltage are applied, wherein the timing controller comprises:

a memory controller to read out a previous image data corresponding to a previous frame previously stored in the memory, store a present image data corresponding to a present frame from an external source in the memory and output the previous image data and the present image data;

a first converter to convert the present image data output from the memory controller into a first sub image data and a second sub image data having a gray scale value less than a gray scale of the first sub image data;

a second converter to convert the previous image data output from the memory controller into a third sub image data and a fourth sub image data having a gray scale value less than a gray scale of the third sub image data;

a first compensator to compensate the first sub image data based on a difference value between the first sub image data and the third sub image data and output a first compensated image data;

a second compensator to compensate the second sub image data based on a difference value between the second sub image data and the fourth sub image data and output a second compensated image data; and, an output part to control an output time of the first and second compensated image data.

8. The LCD of claim 7, wherein the display panel further comprises:

a first gate line to receive the first gate signal during an earlier first H/2 period of a 1H period, the pixel being driven during the entire 1H period and the first subpixel being driven only during the first H/2 period;

a second gate line to receive the second gate signal during a later second H/2 period of the 1H period, the second subpixel being driven only during the second H/2 period; and, a data line to receive the first data voltage during the first H/2 period and the second data voltage during the second H/2 period.

9. The display apparatus of claim 8, wherein the first subpixel comprises:

a first switching device electrically connected to the first gate line and the data line to output the first data voltage in response to the first gate signal; and, a first liquid crystal capacitor which is charged to the first data voltage, and wherein the second subpixel comprises:

a second switching device electrically connected to the second gate line and the data line to output the second data voltage in response to the second gate signal; and, a second liquid crystal capacitor which is charged to the second data voltage.

10. The display apparatus of claim 9, wherein the first data voltage has a higher voltage level than a voltage level of the second data voltage.

* * * * *